United States Patent [19]

De Winter et al.

[11] 4,047,957

[45] Sept. 13, 1977

[54] PROCESS OF HARDENING PROTEIN-CONTAINING PHOTOGRAPHIC LAYERS WITH A MIXTURE OF A CARBOXYL GROUP-ACTIVATING, LOW MOLECULAR WEIGHT COMPOUND AND A CARBOXYL GROUP-ACTIVATING POLYMER

[75] Inventors: Walter Frans De Winter, 's-Gravenwezel; Daniël Maurice Timmerman, Mortsel, both of Belgium

[73] Assignee: AGFA-GEVAERT N.V., Mortsel, Belgium

[21] Appl. No.: 655,878

[22] Filed: Feb. 6, 1976

[30] Foreign Application Priority Data

Feb. 10, 1975 United Kingdom ..... 5653/75

[51] Int. Cl.[2] ..... G03C 1/76; G03C 1/30

[52] U.S. Cl. ..... 96/67; 96/111; 96/114; 260/117; 427/333; 427/338; 106/125; 252/182

[58] Field of Search ..... 96/67, 111, 114; 260/117; 427/338, 333; 106/125; 252/182

[56] References Cited

U.S. PATENT DOCUMENTS

| | | | |
|---|---|---|---|
| 3,100,704 | 8/1963 | Coles et al. | 96/111 |
| 3,321,313 | 5/1967 | Burness et al. | 96/111 |
| 3,671,256 | 6/1972 | Minsk et al. | 96/111 |
| 3,880,665 | 4/1975 | Himmelmann | 96/111 |

*Primary Examiner*—Won H. Louie, Jr.
*Attorney, Agent, or Firm*—William J. Daniel

[57] ABSTRACT

A process is described for the hardening of a proteinaceous layer or layers, more especially of gelatin layers, e.g. gelatin layers in a photographic material, by the application on this layer or layers of a coating composition comprising a low molecular weight, fast-acting, carboxyl group-activating hardening agent in combination with a film-forming, hydrophilic, polymeric, fast-acting hardening agent carrying one or more carboxyl group-activating substituents.

11 Claims, No Drawings

PROCESS OF HARDENING PROTEIN-CONTAINING PHOTOGRAPHIC LAYERS WITH A MIXTURE OF A CARBOXYL GROUP-ACTIVATING, LOW MOLECULAR WEIGHT COMPOUND AND A CARBOXYL GROUP-ACTIVATING POLYMER

The invention relates to a process for the hardening of protein layers, especially gelatin layers, and is of particular importance for hardening proteinaceous photographic layers. The invention also relates to compositions for use in such a process.

The use of fast-acting hardening agents for photographic purposes instead of hardening agents having a retarded action has acquired increased significance lately. As a result of the rapid termination of the hardening reaction, changes in photographic materials during storage are avoided. These changes manifest themselves i.a. in a continuously decreasing permeability of the photographic layers to photographic baths, and in undesired sensitometric effects e.g. a lowering of the contrast.

The use of fast-acting hardening agents in photographic layers, however, gives rise to problems especially related with coating technology. When the normal coating devices are used in which part of the coating solution is returned to the storage container, the necessary addition of the hardening agent becomes impossible. Indeed, the hardening reaction would already be initiated within the coating device itself, so that the coating process would become blocked after a short time.

These difficulties have been known and a number of remedies have been presented, such as the addition of copolymers of acrylic acid and acrylates as described in the United Kingdom Patent Specification 1,275,587. The addition of these compounds, however, brings about an increased swelling of the layer in the photographic baths, e.g. when carbodiimides or isoxazolium salts are used as hardening agents.

Also in the case of suction coaters difficulties are encountered. On the one side the dried layers are rapidly hardened to such an extent that the layers applied subsequently thereto present adhesion defects. On the other hand partial overhardening occurs in the coating solution containing the hardening agents, so that compact particles deposit at the sides of the coating device as well as in the coater itself, thereby impairing the coating quality.

Attempts have been made therefore to incorporate the fast-acting hardening agents into the layers to be hardened, after these layers have already been formed. So, the layers are treated with solutions comprising the hardening agents. For instance, the layers are soaked with a solution containing the hardening agents, or aqueous solutions containing the hardening agents are poured onto the layers to be hardened. It was tried also to apply the hardening agents together with covering or protective layers and to allow the hardening agents to diffuse into the subjacent layers.

The above method of soaking suffers from the disadvantage that the photographic material has to be dried before the treatment with the hardening bath. Moreover, for this treatment a coating system is required, which completely differs from that used for the production of the other layers. When aqueous solutions of hardening agents are poured onto the material, disadvantages are encountered owing to an insufficient wettability of the photographic material to be coated and the resulting impossibility of applying the necessary amount of hardening agent for fully hardening the layer composition.

Also when the hardening compounds are applied together with a covering or protective layer containing gelatin, difficulties are encountered in the coating device as a result of a premature start of the hardening reaction with the gelatin present.

It would be interesting to find a process for the hardening of photographic layers containing protein with fast-acting hardening agents, which allows to use the common coating devices for the manufacture of photographic layers, without giving rise, however, to the distrubances resulting from the short reaction time of the fast-action hardening agents.

For this purpose a process for the hardening with fast-acting hardening agents of photographic layers containing protein, especially of photographic gelatin layers, has been described in the German Patent Application P 2417779. According to this application unhardened or only slightly prehardened photographic layers containing gelatin are coated with hardening solutions, which contain as essential components at least one fast-acting hardening agent, which activates carboxyl groups and at least one linear polysaccharide, in which at least 50% of the hydroxyl groups of the monosaccharide units are acetylated or replaced by an $OSO_3Me$-group, in which Me represents an alkali metal.

By fast-acting hardening agents compounds are meant those, which cause the gelating to harden very quickly, if possible even during the drying process. The hardening maximum mast be reached within 24 hours, of course depending on the temperature, the degree of humidity, and the concentration wherein the hardening agent is present. These fast-acting hardening agents offer the advantage that the photographic material in which they are contained shows neither sensitometric changes nor changes in the swelling characteristics after a prolonged period of storage.

Examples of fast-acting hardening agents given in the above patent application are i.a. carbamolypyridinium and carbamoyloxypyridinium compounds, carbodiimides, isoxazolium salts, and dihydroquinoline derivatives. These fast-acting hardening agents have a carboxyl group-activating influence as the common characteristic. This influence can be illustrated by the known conversion of carbodiimides with carboxylic acids. N-acylurea or acid anhydrides are formed thereby. In the case of proteins containing carboxyl and amino groups, the reaction continues and the activated carboxyl groups together with the amino groups, form peptide bonds. These compounds are therefore known under the name "peptide reagents" (Chemcial Reviews 67 (1967) p. 107–152).

It has now been found that by the use of fast-acting, carboxyl group-activating hardening agents e.g. the so-called "peptide reagents, 38 in combination with layer forming, hydrophilic polymers, which themselves contain such fast-acting hardening groups as side-substituents, several advantages can be obtained as will be demonstrated hereinafter.

According to the invention a process is provided for the hardening of (a) protein or protein-containing layer or layers, e.g. a photographic material layer, especially a photographic layer containing gelatin, characterized in that there is applied over such layer(s) a composition comprising a monomeric or low molecular weight, fast-acting, carboxyl group-activating hardening agent in combination with a film-forming, hydrophilic, polymeric fast-acting hardening agent carrying one or more carboxyl group-activating substituents.

At this stage in the development of the invention, it appears to be greatly preferable for the attainment of very good results, for the polymeric hardening agent to be present in the composition in a greater proportion than the low molecular weight hardening agent. Thus, particular importance is attached to compositions which by virtue of the polymeric hardening agent present therein form on the surface to which the composition is applied, a polymer film or continuous matrix from which the low molecular weight hardening agent(s) migrate(s) or diffuse(s) into the unterlying protein or protein-containing layer(s). The polymer film or coating serves as a protective layer.

In the most preferred compositions, 4 to 20 parts by weight of low molecular weight hardening agent are present for 80 to 96 parts by weight of polymeric hardening agent.

The low molecular weight fast-acting, carboxyl group-activating hardening agents are taken from the group consisting of peptide reagents in general, preference being given to carbamoylpyridinium salts, carbamoyloxypyridinium salts, isoxazolium salts, dihydroquinoline derivatives, and especially carbodiimides. In the polymeric fast-acting hardening agents, the substituents can be derived from the same carboxyl group-activating compounds and are also preferably derived from carbodiimides.

Suitable carbamoylpyridinium salts have been described in Belgian Patent Specification 802,862 and suitable carbamoyloxypyridinium salts in German Patent Application P 2408814.

Dihydroquinoline derivatives that are suitable as low molecular weight fast-acting hardening agents in the process of the present invention have been described in Belgian Patent Specification 816,410 and the isoxazolium salts in United Kingdom patent specification No. 1,275,587. Carbodiimides have been described in U.S. Pat. Nos. 2,938,892 and 3,135,748, in the article of E. Schmidt et al. in Ber., 71, 1933 (1938) and of G. Amiard et al. in Bull. Soc. Chim. France, 1360 (1956).

The further description of the invention will be more especially directed to the use of carbodiimides as the low molecular weight or monomeric hardening agent in combination with hydrophilic polymeric hardening agents carrying carbodiimide side substituents.

Suitable carbodiimides are represented by the general formula:

$$X^1-N=C=N-X^2$$

wherein each of $X^1$ and $X^2$ (same or different) represents alkyl, such as methyl, ethyl, n-propyl, isopropyl, n-butyl, sec.-butyl, isobutyl, tert,-butyl, amyl, hexyl, cyclohexyl, alkoxyalkyl such as methyoxy- or ethoxyethyl or -propyl, allyl, aryl, such as phenyl, totyl; morpholinylalkyl, pyridylalkyl or dialkylaminoalkyl, or $X^1$ represents alkyl (1–5 carbon atoms), alkoxyalkyl or pyridylalkyl, and $X^2$ represents the group

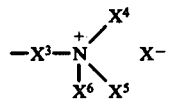

wherein $X^3$ is an alkylene group of 1 to 5 carbon atoms, each of $X^4$ and $X^5$ is alkyl of 1 to 3 carbon atoms, or $X^4$ and $X^5$ together with the N-atom form a six-membered heterocyclic ring such as pyridine or morpholine, $X^6$ is hydrogen or lower alkyl, and X is an anion such as chloride or bromide.

Suitable low molecular weight carbodiimides are the following:

1. $C_2H_5-N=C=N-C_2H_5$
2. $CH_2=CH-CH_2-N=C=N-CH_2-CH=CH_2$
3. $CH_3O-CH_2-CH_2-N=C=N-CH_2-CH_2-OCH_3$
4. 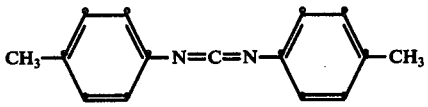
5. $C_2H_5-(CH_3)CH-N=C=N-CH(CH_3)-C_2H_5$
6. $(C_2H_5)_2N-CH_2-CH_2-N=C=N-CH_2-CH_2-N(C_2H_5)_2$
7. 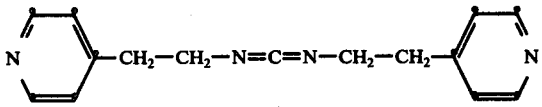
8. $CH_3-N=C=N-CH(CH_3)_2$
9. $C_2H_5-N=C=N-(CH_2)_2-OCH_3$
10. 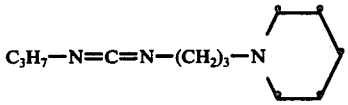
11. 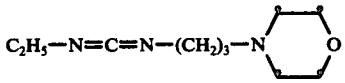

-continued

12.

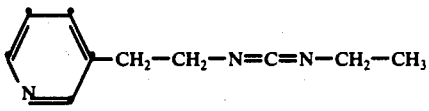

13.

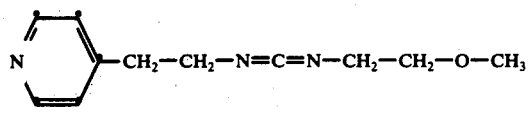

14. $CH_3-N=C=N-(CH_2)_3-N(CH_3)_2$

15. $CH_3-N=C=N-(CH_2)_3-\overset{\oplus}{N}H(CH_3)_2$ $Cl^{\ominus}$

16. $C_2H_5-N=C=N-(CH_2)_3-\overset{\oplus}{N}H(CH_3)_2$ $Cl^{\ominus}$

17. $C_2H_5-N=C=N-(CH_2)_3-\overset{\oplus}{N}(CH_3)_3$ $Cl^{\ominus}$

18. $C_5H_{11}-N=C=N-(CH_2)_3-\overset{\oplus}{N}H(C_2H_5)_2$ $Cl^{\ominus}$

19.

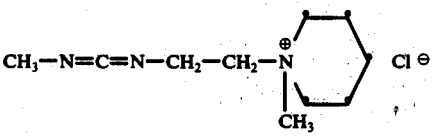

20.

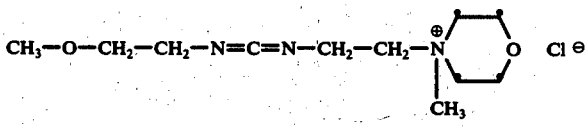

21.

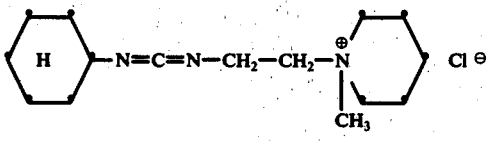

22.

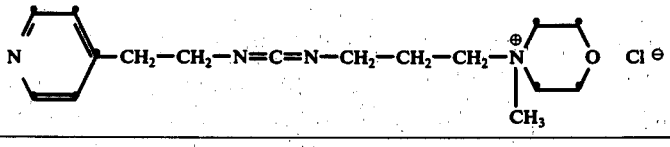

A first class of film-forming, hydrophilic polymeric fast acting hardening agents carrying carbodiimite side-substituents comprise in their structure recurring units corresponding to the formula:

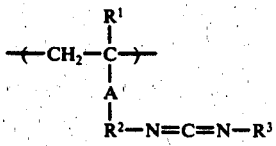

These recurring units may be introduced in the polymer by polymerization of the corresponding monomer or by reaction of a suitable compound with a reactive polymer.

In the above formula A represents a simple chemical bond or a group of one of the formulae:

$-CO.O-$ , $-CONH-$, (I)

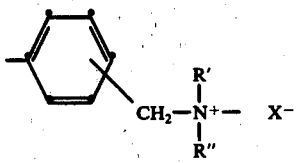

$-CO.O.R'''-\overset{R'}{\underset{R''}{N^+}}-$ $X^-$ $-CO.NH.NH.CO-CH_2-\overset{R'}{\underset{R''}{N^+}}-$ $X^-$ or -continued $$-CO.NH.R^4.NH.CO-CH_2-\overset{\overset{R'}{|}}{\underset{\underset{R''}{|}}{N^+}}- \quad X^-$$

with R′ and R″ representing a methyl or ethyl group, R‴ representing an alkylene group of 1 to 4 carbon atoms, and X representing an anion, preferably a chloride or bromide, $R^1$ represents a hydrogen atom or a methyl group, and each of $R^2$ and $R^3$ represents an alkyl group of 1 to 4 carbon atoms, and $R^4$ represents a phenylene or an alkylene group of 1 to 4 carbon atoms.

Apart from these recurring units deriving from what can be named a vinyl carbodiimide, the hydrophilic polymeric hardening agents can comprise recurring units deriving from other monomers. The principal object of these recurring units is to give well determined properties to the polymeric hardening agents and especially to render the polymer hydrophilic.

Depending on the significance of A in the above formula I the vinyl carbodiimide monomers or their polymers may be obtained by different reaction mechanisms. When A in the above formula I represents a simple chemical bond, the vinyl carbodiimide monomer can be obtained by converting a primary amine with a monomer comprising an isocyanate group into a urea derivative, which thereafter is converted with a tertiary base such as triethylamine into a carbodiimide in the presence of p-toluene sulphonyl chloride as described in Organic Syntheses, vol. 48, pages 83-86. The reaction is as follows:

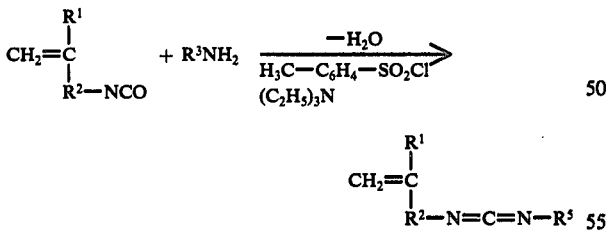

A may also represent a substituted aromatic group. In that case the vinyl carbodiimide can be obtained upon reaction of vinyl benzyl chloride with a dialkylamino-substituted carbodiimide. The reaction is as follows:

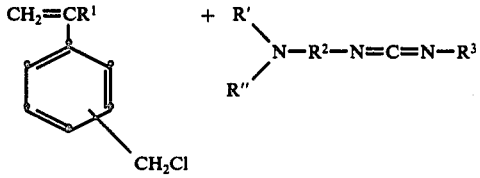

-continued

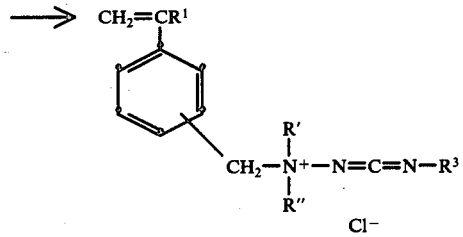

When this reaction is applied to polyvinyl benzyl chloride there is generally also added a trialkylamine such as trimethylamine to the reaction mixture. The final polymer obtained comprises in that case recurring units quaternized with the dialkylamino-substituted carbodiimide, recurring units quaterinized with the trialkylamine, and units deriving from unmodified vinyl benzyl chloride.

To form the vinyl carbodiimides when in formula I the symbol A represents a —CO.O-group, an isocyanate ester of acrylic or methacrylic acid as described in U.S. Pat. No. 2,718,516 is made to react with a primary amine to the corresponding urea compound. The latter is transformed with p-toluene sulphonyl chloride in the presence of a tertiary base such as triethylamine to form the corresponding carboxyester carbodiimide, as described in Organic Syntheses, vol. 48, pages 83–86.

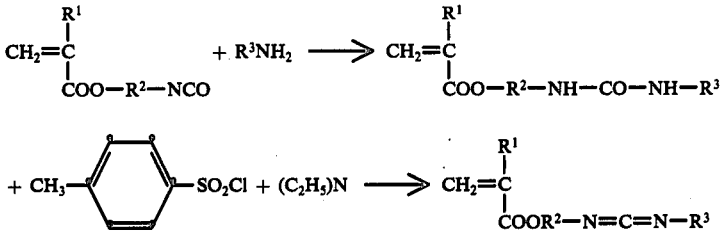

A may also represent a combination of an ester group and a quaternary group. A product of this type can be obtained by making dialkylamino carbodiimide compound react with a polymer possessing reactive chlorine substituents. The latter polymers have been described in U.S. Pat. No. 3,257,208. Representative recurring units possessing reactive chlorine substituents are e.g.

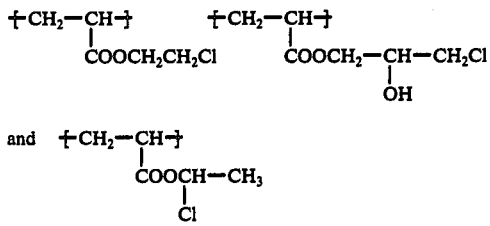

The reaction is e.g. as follows:

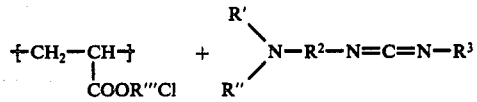

-continued

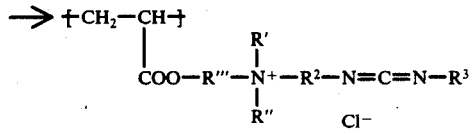

To obtain recurring units of formula I wherein A represents the group

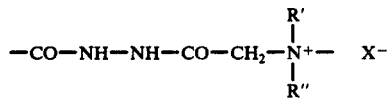

chloroacetylhydrazides as described in U.S. Pat. No. 3,442,655 are made to react with a dialkylamino carbodiimide according to the reaction:

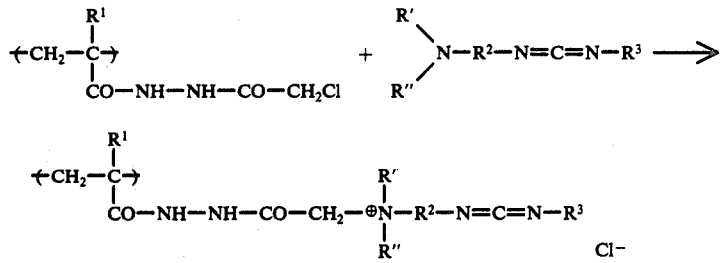

To obtain recurring units of formula I wherein A represents the group

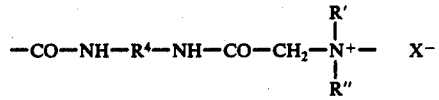

monomers possessing chloromethyl carbonyl groups as described by E. Mueller and K. Dinges in Angew. Makromol. Chem., 27, 99-111 (1972) are quaternized with a dialkylamino-substituted carbodiimide:

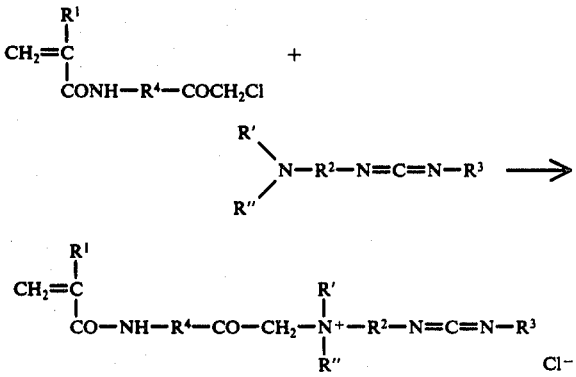

The above reaction can also be applied to polymers carrying chloromethyl carbonyl groups.

A fully different class of hydrophilic polymeric fast-acting hardening agents carrying carbodiimide side-substituents is obtained by quaternizing polyepichlorohydrin or a copolymer of epichlorohydrin and ethylene oxide with a dialkylaminocarbodiimide. The polymers obtained comprise in their structure recurring units of the formula:

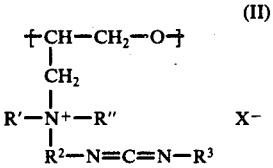

(II)

In all the above formulae $R^1$, $R^2$, $R^3$, $R^4$, R', R'', R''', and X have the same significances as indicated in formula I.

The film-forming, hydrophilic, polymeric, fast-acting hardening agents preferably comprise at least 20 mole % of recurring units carrying carboxyl group-activating substituents. In addition, the polymeric hardening agent may comprise recurring units derived from one or more other unsaturated monomeric materials. When the units comprising carboxyl group-activating substituents derive from water-insoluble or hydrophobic monomers it is necessary to copolymerize these monomers with e.g. up to 80 mole % of unsaturated monomers conferring hydrophilicity to the copolymeric hardener. Among these monomers acrylamide, methacrylamide, N-vinylpyrrolidone, β-hydroxyethyl acrylate and quaternized ammonium derivatives of benzyl chloride can be mentioned.

The ratio of these monomers rendering the copolymeric hardening agents hydrophilic may be very low and even be zero when the units comprising carboxyl group-activating substituents derive from monomers which themselves are soluble in water or highly hydrophilic, as is the case with monomers comprising quaternary ammonium groups.

The copolymer may also comprise, e.g. in a proportion of less than 30 mole %, of a third class of recurring units, i.e. those deriving from hydrophobic unsaturated monomers, mostly present to improve the film-forming properties of the copolymer or to enhance the resistance to abrasion of layers formed therewith. Examples of these hydrophobic monomers are styrene, vinyl toluene, alkyl acrylates and methacrylates wherein the alkyl groups comprise 1 to 4 carbon atoms.

Summarizing, the polymeric fast acting hardening agents are homo- or copolymers formed of at least 20 mole % of monomers comprising carboxyl group-activating substituents, between 0 and 80 mole % of hydrophilic monomers and at most 30 mole % of hydrophobic monomers.

In German Patent Application P 2417779 the hardening solution applied to the gelatin layers to be hardened, comprises a low molecular weight fast-acting hardener and as film-forming material a linear polysaccharide. The fast-acting hardener diffuses in the underlying gelatin layer or layers bringing about the hardening of the gelatin. In the process of the present invention, a low molecular weight fast-acting hardener is used in conjunction with a polymeric, film-forming material comprising fast-acting hardening substituents. The ratio of non-migrating polymeric hardener to low molecular weight migrating hardener should generally speaking be very high. In compositions according to the present invention, it is particularly recommended for the said ratio to be 80 to 96 parts by weight of the polymeric hardener for 4 to 20 parts by weight of low molecular weight migrating hardener.

Whereas in the German Patent Application P 2417779 hardening of gelatin occurs only as a result of the diffusion of the low molecular weight hardener in the underlying gelatin layer, in the process of the present invention hardening apparently also occurs at the interface between the gelatin layer and the layer formed thereon from the mixture of low molecular weight and of polymeric hardeners. Indeed, in the preferred compositions, there is only a relatively minor amount of low molecular weight hardener that can diffuse into the gelatin layer, whereas the polymeric hardener is completely fast to diffusion. The substituent groups of the polymeric hardener activate the carboxyl groups present in gelatin near the interface and they are modified themselves thereby. When the hardening substituents are derived from carbodiimide groups, these carbodiimide groups are transformed into urea groups, which are strongly bound in the interface to the gelatin molecules by means of hydrogen bonds. Thereby the protective layer strongly adheres to the underlying layer so that no reticulation or washing away of the protective layer in the photographic processing solutions can occur.

When the protective layer was dried some chemical changes occurred in this layer. So, it was observed that the protective layer becomes cross-linked and completely insoluble, and although the layer remained fully permeable to the aqueous photographic solutions, it was found that the resistance to abrasion of the photographic material was considerably increased by the presence of this protective layer. At the same time the swelling capacity of the photographic material in photographic processing solutions and in water was greatly reduced. These changes are very interesting, although the exact nature of the chemical reactions occurring within the protective layer during drying are unknown.

To enhanced resistance to abrasion conferred by the protective layer results in a better protection of the underlaying gelatin or other proteinaceous layer or layers against the severe transport conditions in modern fast running processing machines. The resulting photographic material will also swell far less in the photographic baths as compared with analogous materials hardened with the commonly known hardening agents; without, however, reducing the permeability of the layers to photographic processing solutions.

As already explained the fast-acting hardening groups activate the carboxyl groups present in gelatin and other proteins so that these carboxyl groups enter into reaction with the amino groups also present in such protein to form peptide bonds. Thereby the carboxyl-activating groups of the hardener are modified themselves. In the case of carboxyl-activating groups which are substituents of the polymeric fast-acting hardener, the by-products of the hardening reaction remain attached to the polymeric chains and cannot diffuse into the underlying layer, so that they cannot cause any undesirable photographic side-effect in this underlying layer.

Only the relatively small quantity of low molecular weight fast-acting hardener can diffuse into the underlying layer. Of course, by products of the hardening reaction caused by such hardener remain present in this layer. Since, however the quantity of low molecular weight hardener can be reduced considerably, its influence on the photographic properties is also markedly smaller than would be the case if the complete hardening effect of the photographic material had to be brought about by the low molecular weight fast-acting hardener alone.

A coating composition used according to the invention may incorporate in addition to the said monomeric and polymeric fast-acting hardening agents, one or more conventional i.e. more slow-acting hardening agents.

In a very interesting modification of the process as hereinbefore defined, one or more conventional hardening agents is or are used instead of a low molecular weight fast-acting hardener. The invention includes any such modified process. In such a modified process, any of the polymeric fast-acting hardening agents hereinbefore referred to can be used. When applying the modification process the conventional hardening agent(s) will also diffuse from the protective layer formed by the polymeric substance(s) into the underlying gelatin or other proteinaceous layer(s) and aid in the hardening of such layer(s) upon drying.

The composition containing the combination of low molecular weight fast-acting hardening agent and of polymeric material carrying also fast-acting hardening groups can be applied as an outer, protective layer to the photographic material consisting of one or more hardenable layers. In principle, the process of the invention is also suitable for the production of photographic intermediate layers, e.g. in a colour photographic multilayer material. In order to avoid adhesion problems during the coating of the following layers, it is preferred to harden partially e.g. by reducing the ratio of the low molecular weight hardening agent.

In general, a mixture of water and of solvents that are miscible with water is used as solvent in forming the solution for the production of the protective layer. Suitable water-miscible solvents are alcohols such as methanol and ethanol, isopropanol and also acetone. The solutions can contain the usual wetting agents such as saponine, succinic acid diester or non-ionic compounds such as e.g. saccharose monofatty acid ester, alkylpolyethylene glycols and fluoroalkyl sulphonic acids.

In general, satisfying results are obtained with coating compositions comprising from 3 to 20 g of polymeric hardener per 100 ml of coating composition, the ratio of low molecular weight hardener in the coating composition varying from 4 to 20 parts by weight for 80 to 96 parts by weight of polymeric hardening agent. It is suitable to apply the coating composition in an amount such that after drying a protective layer of 0.2 to 5 $\mu$m, preferably of 1 to 2 $\mu$m in thickness is obtained.

A photographic material treated in this way is capable, after drying and storage for one day, of withstanding mechanical stress during machine processing at up to 55° C.

The combination consisting of fast-acting polymeric and low molecular weight hardening agents according to the invention can contain one or more than one of each of these hardening agents. The combination can also be used advantageously for the hardening of photographic layers, which in addition to gelatin contain other homo- and copolymers having carboxyl substituents. It is assumed that the mixture of different fast-acting hardening agents contained in the combination can also induce the cross-linking of gelatin and polymers containing carboxyl groups.

Any known method for the formation of layers can be used for the application of the composition comprising the combination of fast-acting hardening agents.

These coating systems are known to those skilled in the art of the production of photographic layers. A description of the coating processes used in photography is given in e.g. "Ullmanns Encyclopaedie der technischen Chemie," 3rd edition, Part 13 (1962) pages 641-645. In the description reference is made to special coating methods. Information about a suction coating-device can be found e.g. in the U.S. Pat. Nos. 3,645,773, 3,663,292 and the United Kingdom patent specifications Nos. 1,216,066, 1,219,223, 1,219,224 and 1,219,225. A description of the vacuum air-knife coater can be found in the U.S. Pat. Nos. 3,635,192 and 3,654,899, the United Kingdom patent specification No. 1,229,374, or the German Patent Specification 1,577,722.

The invention can be applied for hardening a layer consisting of or containing gelatin or other hardenable protein, and forming part of any photographic material, particularly light-sensitive photographic material. A photographic material treated according to the invention may comprise, in addition to one or more light-sensitive silver-halide emulsion layers, at least one layer of one or more of the kinds : protective layers, filter layers, antihalation layers, backing layers and, more generally, photographic auxiliary layers.

Light-sensitive emulsion layers, which can be hardened by a process according to the invention, include layers which essentially consist of non-sensitized emulsions, X-ray emulsions and other spectrally sensitized emulsions. The hardening process according to the invention is also suitable for the hardening of the gelatin layers used in different photographic black-and-white and colour processes. The process of the invention for the hardening of photographic layer compositions appears to be advantageous for carrying out colour photographic processes such as e.g. those using emulsion layers with colour couplers or emulsion layers, which are intended for treatment with solutions comprising colour couplers.

The invention can be employed for hardening photographic layers which contain in addition to the usual photographic additives other, non-fast acting, conventional hardening agents such as formalin, mucochloric acid, triacrylformal and dialdehydes or any inorganic salt such as e.g. chromium(III), aluminium(III), or zirconium salts.

Besides gelatin the photographic layers may also contain water-soluble high polymeric compounds e.g. polyvinyl alcohol, polyacrylic acid, copolymers containing carboxyl groups, polyvinyl pyrrolidone, polyacrylamide or high molecular weight natural substances, such as dextrane, dextrine, starch ether, alginic acid or derivatives thereof.

For the evaluation of the test results described in the examples, the following methods have been used.

In order to determine the water absorption, the sample is developed in an original colour developer as a black sheet and weighed after the final bath and after skimming of the excess water. The sample is then dried and weighed again. The difference measured per surface unit of 1 sq.m of the test sample yields the water absorption per sq.m.

The swelling is measured gravimetrically after a treatment of 10 min. of a test sample in distilled water at 22° C. It is determined by the swelling factor:

$$\frac{\text{weight of the layer in wet condition}}{\text{weight of the layer in dry condition}} = \text{swelling factor.}$$

For the determination of the scratch resistance in wet condition, a metal ball of a given size is drawn over a wet layer and charged with an increasing weight. Prior to this measurement, the coated film after having been dried for 1 hour at 30° C, was hardened for 48 hours at 21° C and a relative humidity of 60%. Subsequently, the film was immersed for 20 minutes in water at the temperature indicated. The scratch resistance in wet condition is given by the weight at which the ball leaves a visible scratch trace on the layer. A high weight corresponds with a high scratch resistance in wet condition.

The determination of the gamma-values is performed as usual in photographic practice.

According to the hardening process of the invention, the coating problems connected with the use of fast-acting hardening agents can be solved surprisingly well. These problems have considerably impaired the applicability of such hardening agents so far. By means of the process of the invention it is possible now to use fast-acting hardening agents irrespective of the coating system used for the production of the photographic material and to take full advantage of the characteristics of such coating systems e.g. for the production of photographic materials suited for processing at increased temperatures.

The preparation of the polymeric fast-acting hardening agents is exemplified by the following preparation of a copolymer carrying carbodiimide side substituents.

A. Preparation of polyvinyltoluene

A reaction vessel was provided with a stirrer, cooling means to keep the temperature of the reaction mixture at about 80° C, a reflux condenser, and a contact thermometer. In a second vessel were mixed at room temperature with stirring:

| | |
|---|---|
| vinyl toluene | 600 g |
| demineralized water | 2000 ml |
| dodecylated oxydibenzene disodium sulphonate | 12 g |
| sodium tetradecyl sulphate | 12 g |
| sodium dodecyl sulphate | 12 g |
| sulphated diisoheptyl-isohexyl-phenyl-polyoxyethylene | 18 g |
| potassium persulphate | 6 g |

The vinyltoluene had been freshly distilled at 62° C/15 mm Hg, the para-isomer constituting the predominating isomer.

0.5 l of the emulsion obtained were introduced within a few minutes into the reaction vessel containing already 1 l. of demineralized water. The emulsion was heated at 80° C to start polymerisation. The polymerisation reaction was slightly exothermic and the reaction mixture was cooled to keep it at 80° C. After 15 minutes at 80° C the remainder of the emulsion was introduced into the reaction vessel within 35 minutes. Polymerisation was continued for 2 hours at 80° C with continuous stirring.

The dispersion was cooled then to room temperature and 7.5 l of acetone were added dropwise to the dispersion. After sucking off of the precipitate, the polyvinyl toluene was obtained in the form of a white powder.

The powder was washed again with 3 l of demineralized water, sucked until dry and further dried in a ventilated drying cabinet at 50° C and thereafter for 24 hours under a vacuum of 1 mm Hg at 70° C. The polyvinyl toluene had an intrinsic viscosity of 0.73 dl/g when measured in butanone at 25° C. Yield: 593 g.

B. Preparation of polyvinyl benzyl chloride 118 g of the above prepared polyvinyl toluene were dissolved in 1 of carbon tetrachloride in a reaction vessel provided with a stirrer, a dropping funnel, a reflux condenser, an inlet tube for nitrogen gas, and a contact thermometer for keeping the reaction mixture at 70° C. In order to evacuate all water present some 100 ml of carbon tetrachloride were distilled over. 1 g of dibenzoyl peroxide was now added to catalyze the chlorination reaction. When the temperature of the reaction vessel was lowered from about 76° C to 70° C, there were added dropwise 270 g (2 moles) of sulphuryl chloride within about 45 minutes to the solution.

During the addition of the sulphuryl chloride a gentle stream of nitrogen gas was introduced into the solution to eliminate the HCl and $SO_2$ formed. These gases were collected in a flask with water. After all the sulphuryl chloride had been added, the mixture was stirred for a short time at 70° C.

The polymer is isolated after a total reaction time of 2 hours. This was obtained by previously cooling the mixture to 50° C and by eliminating the excess of sulphuryl chloride by the slow addition of 0.5 l of methanol. After the addition of another quantity of methanol the polymer precipitated in the form of a tacky residue.

The polyvinyl benzyl chloride was purified by washing the tacky residue with 1 l of methanol, dissolving it in 1 of acetone and pouring the solution with stirring into 6 l of methanol. The white powdery polymer was filtered off and dried in a ventilated drying cabinet at 50° C.

Analysis showed that the product contained 5.81 m.e.q. of chlorine/g of product, which corresponds with a 85.8 mol % vinyl benzyl chloride content in the copolymer, the remaining 14.2 mol % being unmodified vinyl toluene groups.

C. Preparation of polymer containing carbodiimide side-substituents

In a reaction vessel provided with a stirrer, a reflux condenser, and a thermometer 15 g of the above-mentioned copolymer of vinyl benzyl chloride and vinyl toluene were dissolved in 30 ml of anhydrous methylene chloride. 4.06 g of N-dimethylaminopropyl-N'-ethylcarbodiimide were introduced with stirring at room temperature. The latter product was obtained as described in Organic Syntheses Vol. 48, 83–86. The solution was heated at 38° C. 30 ml of ethylene glycol monomethyl ether were added as solvent for the quaternization product. The temperature immediately increased to 43° C. After some 20 minutes the slightly exothermic reaction ended and the temperature was then kept at 40° C by heating After a total reaction time of 2 hours, 26.2 ml of a solution of 3.09 g of trimethylamine in methanol were added and the quaternization was continued for 2 hours with stirring at 50° C.

The solution was cooled at room temperature and poured in 800 ml of ether to isolate the carbodiimide copolymer. The precipitated copolymer was washed with 200 ml of ether and dissolved in methanol.

Yield: 135 ml of solution comprising 20.8 g of copolymer of the formula :

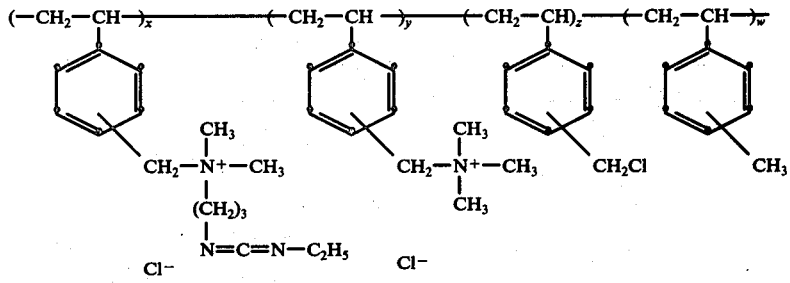

The values for $x$, $y$, $z$, and $w$ were 26.2, 52.6, 7.2, and 14.0 mole % respectively.

In a similar reaction the amount of 4.06 g of N-dimethylamino-propyl-N'-ethyl carbodiimide was reduced to 2.03 g and instead of 26.2 ml of a solution of 3.09 g of trimethylamine in methanol, 32.75 ml of a 2 molar solution of trimethylamine in methanol were used. Yield: 150 ml of solution in methanol of 20.7 g of polymer corresponding to the above formula, wherein $x$ = 13.1 mole %
$y$ = 65.7 mole %
$z$ = 7.2 mole %
$w$ = 14.0 mole %

The following Examples illustrate the invention.

EXAMPLE 1

A polyethylene terephthalate film, which had been oriented biaxially and heat-set in known manner is provided with known subbing layer. This layer was coated with the following composition :

10 % aqueous gelatin solution: 100 ml
1 % aqueous saponin solution: 10 ml

This coating composition was applied in such a quantity that upon drying a gelatin layer of 10 μm was obtained. Different samples of the coated film were treated as follows :

(1). upon the gelatin layer a layer was coated from the following composition :

5 % aqueous solution of gelatin: 4 ml
5 % aqueous solution of saponin: 4 ml
carbodiimide No. 14 (see list above): 22.2 mg The carbodiimide No. 14 was used in the form of its hydrochloride.

2.

5 % aqueous solution of KELCO SCS: 10 ml

5 % aqueous solution of saponin: 1 ml
carbodiimide No. 14: 22.2 mg

KELCO SCS is the trade name of a cellulose sulphate marketed by KELCO Company, New Jersey, U.S.A.

3.
4.5 % solution in methanol of carbodiimide containing polymer: 10 ml
carbodiimide No. 14 as a 5 % aqueous solution: 0.44 ml.

The carbodiimide-containing polymer used was derived from vinyl toluol as described in the above Preparation and consisted of the same recurring units as indicated in the above formula wherein *x, y, z,* and *w* represented 26.2, 52.6, 7.2, and 14.0 mole % respectively.

All these coating compositions were applied in such a manner that after drying a layer of 2 μm was obtained.

The resistance to abrasion of the three different covering layers and the swelling factor of the three materials formed were measured as indicated above. The following results were obtained :

| Material no. | Resistance to abrasion in water | | | Swelling factor | | |
|---|---|---|---|---|---|---|
| | 20° C | 38° C | 52° C | 20° C | 35° C | 50° C |
| (1) | 400 g | 150 g | 50 g | *— | *— | *— |
| (2) | 1200 g | 1100 g | 850 g | 4.5 | 4.5–5.6 | 3.5 |
| (3) | 1350 g | 1400 g | 1500 g | 2.6 | 2.9 | 2.5 |

*could not be measured.

From this table it can easily be deduced that with material No. 3, wherein the combination of low molecular weight and of polymeric fast-acting hardening agents has been applied as a protective layer to the gelatin layer, the best results are obtained. The resistance to abrasion of the wet protective layer is greatest and the swelling factor of the material in water is considerably reduced. It was also found that the protective layer of material No. 3 was rendered completely insoluble in water after drying.

EXAMPLE 2

A photographic colour positive material containing on a cellulose triacetate film support a blue-sensitive layer with appropriate yellow colour coupler, a red-sensitive layer with appropriate cyan colour coupler, and a green-sensitive layer containing a magenta colour coupler was made in known manner. To form the coating compositions for these layers the required amounts of gelatino silver halide emulsion, spectral sensitizers, stabilizers, wetting agents and the like were added in known manner.

The resulting dried positive colour material was coated with a protective layer from the following coating composition.

carbodiimide No. 14 (see list above) as a 4 % solution in water: 25 ml
carbodiimide copolymer of Example 1 as a 4 % solution in methanol: 500 ml
saponine : 10% aqueous solution: 10 ml The carbodiimide No. 14 was used in the form of its hydrochloride.

The above amount of coating composition was applied to 10 sq.m. of positive colour material and dried thereafter. The measurement of the abrasion resistance of the material gave the following results :

at 25° C : abrasion resistance of 800–1100 g
at 36° C : abrasion resistance of 500–700 g When the carbodiimide copolymer was omitted from the above coating composition, the values of abrasion resistance of the material were 200–500 and 100–150 respectively.

It was observed that the γ-values of the photographic layers and the other photographic properties of the material were not impaired by the presence of the carbodiimide hardeners.

We claim:

1. A process for treating silver halide photographic materials which include a protein-containing layer to harden such layer which comprises the step of applying over such layer a layer comprising a mixture of a low molecular weight, fast-acting, carboxyl group-activating hardening agent with a larger amount of a film-forming, hydrophilic, polymeric, fast-acting hardening agent carrying at least one carboxyl group-activating carbodiimide substituent, said low molecular weight hardening agent being selected from the group consisting of carbamoylpyridinium salts, carbamoyloxypyridinium salts, isoxazolium salts, dihydroquinoline compounds, and carbodiimides.

2. A process according to claim 1, wherein the layer to be hardened contains gelatin.

3. A process according to claim 1, wherein the low molecular weight, fast-acting, carboxyl group-activating hardening agent corresponds to the general formulas:

$$X^1 - N = C = N - X^2$$

wherein each of $X^1$ and $X^2$ (same or different) represents alkyl of 1 to 6 carbon atoms, cyclohexyl, alkoxyalkyl, allyl, phenyl, tolyl, morpholinoalkyl, pyridylalkyl, or dialkylaminoalkyl,
or $X^1$ represents alkyl, alkoxyalkyl or pyridylalkyl and $X^2$ represents the group

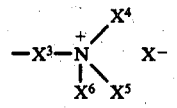

wherein $X^3$ is an alkylene group of 1 to 5 carbon atoms, each of $X^4$ and $X^5$ is alkyl of 1 to 3 carbon atoms, or $X^4$ and $X^5$ together form with the N atom a six-membered heterocyclic ring, $X^6$ is hydrogen or lower alkyl and X is an anion.

4. A process according to claim 3, wherein the low molecular weight, fast-acting, carboxyl group-activating hardening agent is N-methyl-N'-(3-dimethylaminopropyl)carbodiimide.HCl.

5. A process according to claim 1, wherein the polymeric fast-acting hardening agent comprises in its structure recurring units corresponding to the formula:

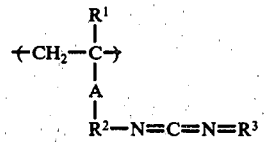

wherein A represents a single chemical bond or a group according to one of the formulae:

—CO . O— , —CONH—,

-continued

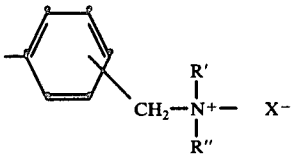

$-CO.O.R'''-\overset{R'}{\underset{R''}{N}}{}^{+}-\ X^-$ $-CO.NH.NH.CO-CH_2-\overset{R'}{\underset{R''}{N}}{}^{+}-\ X^-$ or $-CO.NH.R^4.NH.CO-CH_2-\overset{R'}{\underset{R''}{N}}{}^{+}-\ X^-$ with R′ and R″ representing a methyl or ethyl group, R‴ representing an alkylene group of 1 to 4 carbon atoms, and X representing an anion, $R^1$ represents a hydrogen atom or a methyl group, and each of $R^2$ and $R^3$ represents an alkyl group of 1 to 4 carbon atoms, and $R^4$ represents a phenylene or an alkylene group of 1 to 4 carbon atoms.

6. A process according to claim 7, wherein the polymeric, fast-acting hardening agent corresponds to the structural formula:

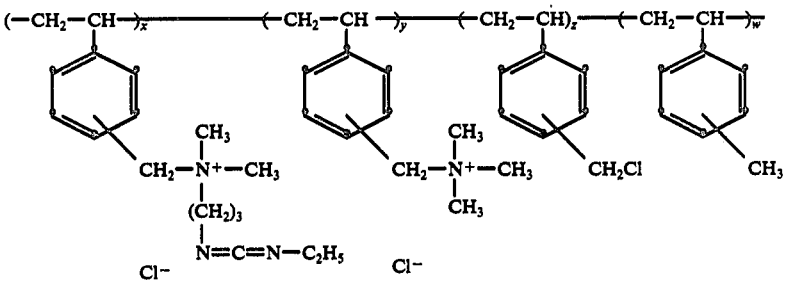

wherein *x, y, z,* and *w* are 26.2, 52.6, 7.2, and 14.0 mole % respectively.

7. A process according to claim 1, wherein the polymeric, fast-acting hardening agent comprises in its structure recurring units corresponding to the formula:

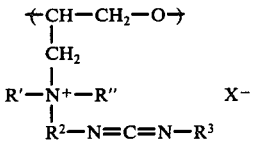

wherein each of $R^2$ and $R^3$ represents an alkyl group of 1 to 4 carbon atoms, R′ and R″ represent a methyl or ethyl group, and X represents an anion.

8. A process according to claim 1, wherein the coating composition comprises 4 to 20 parts by weight of said low molecular weight, fast-acting, carboxyl group-activating hardening agent and 80 to 96 parts by weight of said polymeric fast-acting hardening agent carrying carboxyl group-activating substituents.

9. A process according to claim 1, wherein the applied coating composition forms after drying a layer of 0.2 to 5 μm in thickness.

10. A silver halide photographic material containing at least one protein-containing layer and a superposed contacting layer comprising a mixture of a low molecular weight, fast-acting, carboxyl group-activating hardening agent with a larger amount of a film-forming, hydrophilic, polymeric, fast-acting hardening agent carrying at least one carboxyl group-activating carbodiimide substituent, said low molecular weight hardening agent being selected from the group consisting of carbamoylpyridinium salts, carbamoyloxypyridinium salts, isoxazolium salts, dihydroquinoline compounds, and carbodiimides.

11. A photographic material according to claim 10, wherein the protein containing layer comprises gelatin.

* * * * *

UNITED STATES PATENT AND TRADEMARK OFFICE

CERTIFICATE OF CORRECTION

PATENT NO. : 4,047,957

DATED : September 13, 1977

INVENTOR(S) : Walter Frans De Winter et al

It is certified that error appears in the above-identified patent and that said Letters Patent are hereby corrected as shown below:

In the Claims:

Claim 6, line 1, "7" should read -- 5 --.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*